US010053309B2

(12) United States Patent
Washino

(10) Patent No.: US 10,053,309 B2
(45) Date of Patent: Aug. 21, 2018

(54) SHEET TRAY

(71) Applicant: BROTHER KOGYO KABUSHIKI KAISHA, Nagoya-si, Aichi-ken (JP)

(72) Inventor: Yoshiyuki Washino, Gifu-Ken (JP)

(73) Assignee: BROTHER KOGYO KABUSHIKI KAISHA, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/453,033

(22) Filed: Aug. 6, 2014

(65) Prior Publication Data

US 2015/0042030 A1 Feb. 12, 2015

(30) Foreign Application Priority Data

Aug. 7, 2013 (JP) ..... 2013-164588

(51) Int. Cl.
*B65H 31/20* (2006.01)
*B65H 1/04* (2006.01)
*B65H 31/02* (2006.01)

(52) U.S. Cl.
CPC ..... *B65H 1/04* (2013.01); *B65H 31/02* (2013.01); *B65H 31/20* (2013.01); *B65H 2301/4212* (2013.01); *B65H 2405/1124* (2013.01); *B65H 2405/11164* (2013.01); *B65H 2405/12* (2013.01); *B65H 2405/324* (2013.01); *B65H 2405/3322* (2013.01); *B65H 2551/29* (2013.01); *B65H 2801/06* (2013.01)

(58) Field of Classification Search
CPC ..... B65H 2405/10; B65H 2405/1117; B65H 2405/11172; B65H 2405/1122; B65H 31/00; B65H 31/20; B65H 1/04
USPC ..... 271/145, 9.01, 9.08, 9.09
See application file for complete search history.

(56) References Cited

U.S. PATENT DOCUMENTS

| | | | | |
|---|---|---|---|---|
| 6,390,466 | B1 * | 5/2002 | Sanmiya | 271/213 |
| 2005/0141936 | A1 * | 6/2005 | Kawashima | 399/392 |
| 2009/0194935 | A1 | 8/2009 | Wakakusa et al. | |

(Continued)

FOREIGN PATENT DOCUMENTS

| | | | |
|---|---|---|---|
| JP | 11-199062 | * | 7/1999 |
| JP | 11-268377 | A | 10/1999 |
| JP | 2000-198605 | A | 7/2000 |

(Continued)

OTHER PUBLICATIONS

Machine translation of JP 2001-163454.*

(Continued)

*Primary Examiner* — Thomas A Morrison
(74) *Attorney, Agent, or Firm* — Merchant & Gould P.C.

(57) ABSTRACT

A sheet tray includes: a first receiving member; a second receiving member including a first holding portion configured to be pushed into and drawn out from the first receiving member and a third receiving member including a second holding portion configured to be pushed into and drawn out from the second receiving member. The first receiving member covers the second and third receiving members in a state of being pushed into. The second receiving member is configured to expose the second holding portion while maintaining a state in which the third receiving member can be drawn out. The first receiving member is configured to expose the second holding portion while maintaining a state in which the third receiving member can be drawn out.

12 Claims, 11 Drawing Sheets

(56) References Cited

U.S. PATENT DOCUMENTS

2010/0124449 A1 5/2010 Asada et al.

FOREIGN PATENT DOCUMENTS

| | | | |
|---|---|---|---|
| JP | 2001-163454 | * | 6/2001 |
| JP | 2001-302070 A | | 10/2001 |
| JP | 2004-216590 | * | 8/2004 |
| JP | 2005-1825 | * | 1/2005 |
| JP | 2008-81246 | * | 4/2008 |
| JP | 2010-30755 | * | 2/2010 |
| JP | 2010-173832 A | | 8/2010 |
| JP | 2010-235296 A | | 10/2010 |
| JP | 2011-11859 | * | 1/2011 |
| JP | 2011-235986 A | | 11/2011 |

OTHER PUBLICATIONS

Machine translation of JP 11-199062.*
Machine translation of JP2010-30755.*
Notice of Reasons for Rejection (Office Action) issued in corresponding Japanese Patent Application No. 2013-164588, dated Jan. 4, 2017.
Notice of Reasons for Rejection (Office Action) issued in corresponding Japanese Patent Application No. 2013-164588, dated Oct. 10, 2017.

* cited by examiner

SHEET TRAY

CROSS REFERENCE TO RELATED APPLICATION

The present application claims priority from Japanese Patent Application No. 2013-164588, filed on Aug. 7, 2013, the disclosure of which is incorporated herein by reference in its entirety.

BACKGROUND

Field of the Invention

The present invention relates to a sheet tray which supports a sheet to be fed to an apparatus or a sheet discharged from the apparatus.

Description of the Related Art

An image recording apparatus such as a printer is provided with a sheet tray such as a manual-paper-feed tray on which a sheet to be fed to the apparatus is placed, and a discharge tray on which, a sheet discharged from the apparatus is placed.

In recent years, a small-sizing of the image recording apparatus is required. However, it is also required to record an image on a recording paper of a large size by the image recording apparatus. As an apparatus which is capable of fulfilling these two contrary requirements, a discharge stacker which enables to draw each of a plurality of stacking members that are overlapped, from the stacking member directly above has hitherto been known. In the abovementioned discharge stacker, since a length along a direction in which each stacking member is drawn can be short, it is possible to make the image recording apparatus small. Meanwhile, in the abovementioned discharge stacker, it is possible to make long the length of the plurality of stacking members as a whole, along the direction in which the stacking member is drawn, by drawing out all of the plurality of stacking members. Accordingly, the discharge stacker is capable of supporting a recording paper of a large size.

SUMMARY

However, even in an image recording apparatus equipped with a discharge stacker, which is capable of recording an image on a recording paper of a large size, sometimes the image recording is to be carried out on a recording paper of a small size. In such case, if all of the plurality of stacking members is drawn out, a supporting surface on which the recording paper in the discharge stacker is supported becomes too long, as compared to a recording paper that is discharged upon having an image recorded thereon. On the other hand, it is troublesome to adjust a length of drawing of each stacking member or divide the plurality of stacking members into two types of members, that is, members that can be drawn and members that cannot be drawn, for making the supporting surface which supports the recording paper in the discharge stacker, to be of a size suitable for supporting the recording paper.

The present teaching has been made in view of the abovementioned circumstances, and an object of the present teaching is to provide a sheet tray which enables to form a supporting surface of a size suitable for a sheet size without making it complex.

According to an aspect of the present teaching, there is provided a sheet tray provided on an apparatus, including:

a first receiving member including a first supporting surface configured to support a sheet to be fed to or a sheet discharged from the apparatus;

a second receiving member including a first holding portion and a second supporting surface configured to support the sheet, the second receiving member being supported by the first receiving member to be movable to a first position and a second position along a first direction in which the sheet is fed or discharged, the first position being a position at which the second supporting surface overlaps with the first supporting surface, and the second position being a position at which an overlapping area of the second supporting surface with respect to the first supporting surface is smaller than an overlapping area of the second supporting surface with respect to the first supporting surface, at the first position; and a third receiving member including a second holding portion and a third supporting surface configured to support the sheet and, the third receiving member being supported by the second receiving member to be movable to a third position and a fourth position along the first direction, the third position being a position at which the third supporting surface overlaps with the second supporting surface, and the fourth position being a position at which an overlapping area of the third supporting surface with respect to the second supporting surface is smaller than an overlapping area of the third supporting surface with respect to the second supporting surface, at the third position, wherein in a state that the second receiving member is located at the first position and the third receiving member is located at the third position, one of the first receiving member, the second receiving member, and the third receiving member, which is at the uppermost position, covers the other of the first, second and third receiving members positioned under the one of the first, second and third receiving members, and one of the first receiving member and the second receiving member which is positioned toward the second holding portion of the third receiving member at the third position, is configured to expose the second holding portion with maintaining a state in which the third receiving member is movable from the third position to the fourth position, and one of the first receiving member and the second receiving member which is positioned toward the first holding portion of the second receiving member at the first position, is configured to expose the first holding portion with maintaining a state in which the second receiving member is movable from the first position to the second position.

As a user of the sheet tray moves the second receiving member in the first direction by holding the first holding portion, the second receiving member is drawn out from the first receiving member and moves from the first position to the second position. At this time, the third receiving member that has been supported by the second receiving member moves integrally with the second receiving member in the first direction. In other words, the third receiving member, not being touched by the user, does not move with respect to the second receiving member. Accordingly, by the user moving the second receiving member to the second position by holding the first holding portion, a supporting surface of a sheet in the sheet tray is formed by the first supporting surface and the second supporting surface.

On the other hand, as the user moves the third receiving member in the first direction by holding the second holding portion, the third receiving member is drawn out from the second receiving member and moves from the third position to the fourth position. Moreover, as the user moves further the third receiving member in the first direction, the second receiving member which supports the third receiving member moves integrally with the third receiving member in the first direction. As a result, the second receiving member is drawn out from the first receiving member and moves from the first position to the second position. Accordingly, when the user moves the third receiving member in the first direction by holding the second holding portion, the third receiving member moves to the fourth position, and the second receiving member moves to the second position. As a result, the sheet surface of the sheet in the sheet tray is formed by the first supporting surface, the second supporting surface, and the third supporting surface.

Accordingly, with the present arrangement, it is possible to change the size of the supporting surface of the sheet in accordance with the holding portion held by the user. Concretely, by the user moving by holding the first holding portion in the first direction, it is possible to make the size of the supporting surface of a sheet to be a size appropriate for supporting a sheet of a predetermined size, and by the user moving by holding the second holding portion in the first direction, it is possible to make the size of the supporting surface of a sheet to be a size appropriate for supporting a sheet of a size larger than the predetermined size.

In the sheet tray according to the present teaching, it is possible to form the supporting surface of an appropriate size corresponding to the sheet size only by selecting the holding portion held by the user from the plurality of holding portions, or in other words, without taking much trouble.

DETAILED DESCRIPTION OF THE PREFERRED EMBODIMENTS

Figure 1:
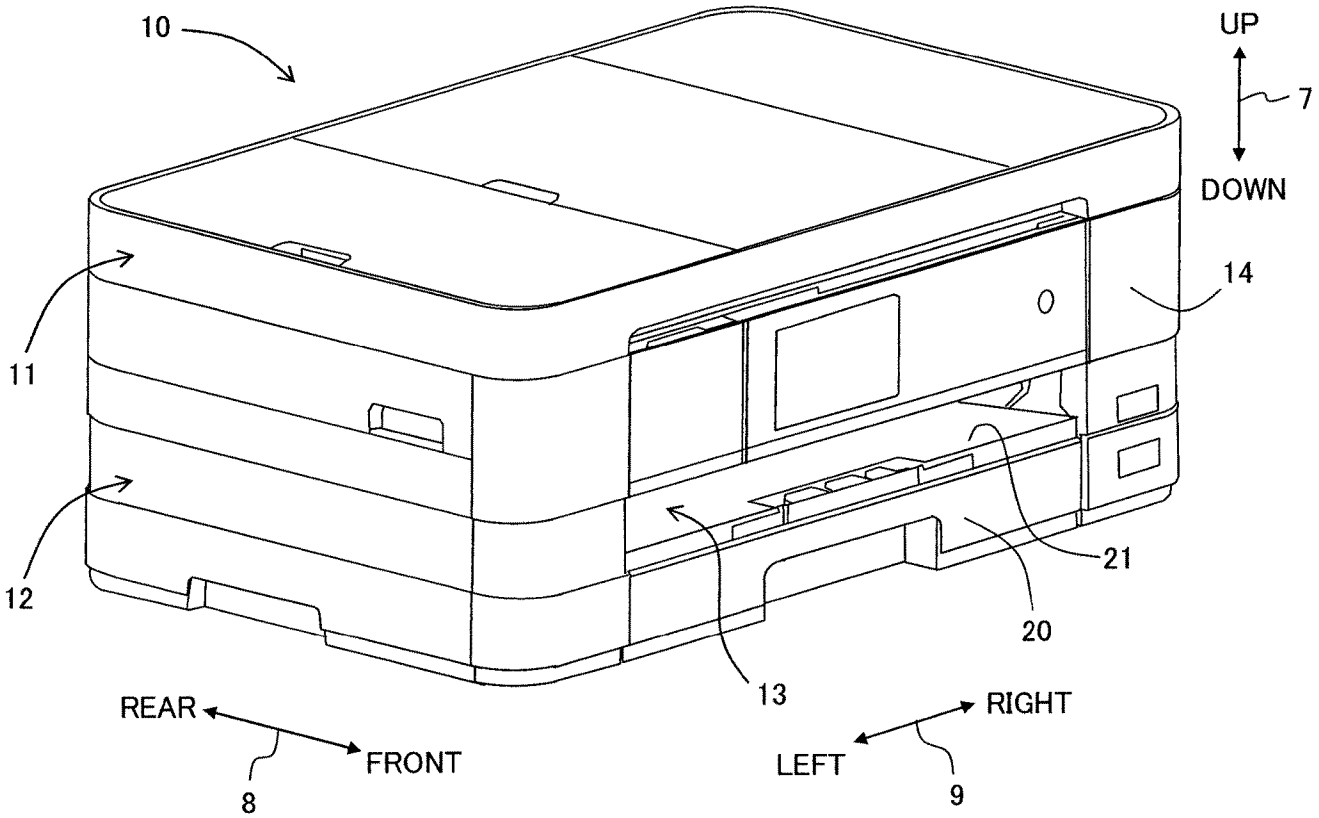
FIG. 1 is a perspective view of a multi-function peripheral 10.

An exemplary embodiment of the present teaching will be described below. However, the embodiment described below is merely an example of the present teaching, and it is needless to mention that it is possible to modify the embodiment appropriately within the scope of the present teaching. Moreover, in the following description, a up-down direction 7 is defined with a state of a multi-function peripheral 10 usably installed (a first state), a front-rear direction 8 is defined with a side on which an opening 13 is provided, as a frontward side, and a left-right direction 9 is defined upon viewing the multi-function peripheral 10 from the frontward side (front).

[Overall Arrangement of Multi-Function Peripheral 10]

As depicted in FIG. 1, the multi-function peripheral 10 (an example of an apparatus of the present teaching) has a substantial rectangular parallelepiped shape. At an upper portion of the multi-function peripheral 10, a scanner section 11 which reads an image recorded on a document by an image sensor and acquires image data, is provided. At a lower portion of the multi-function peripheral 10, a printer section 12 which records an image on a recording sheet 15 (an example of a sheet of the present teaching, refer to FIG. 2), based on the image data etc. is provided. The scanner section 11 is a so-called flatbed scanner. However, description in detail of an internal arrangement of the scanner section 11 is omitted here. The printer section 12 has a casing 14, and the opening 13 formed in a front face of the casing 14.

Figure 2:
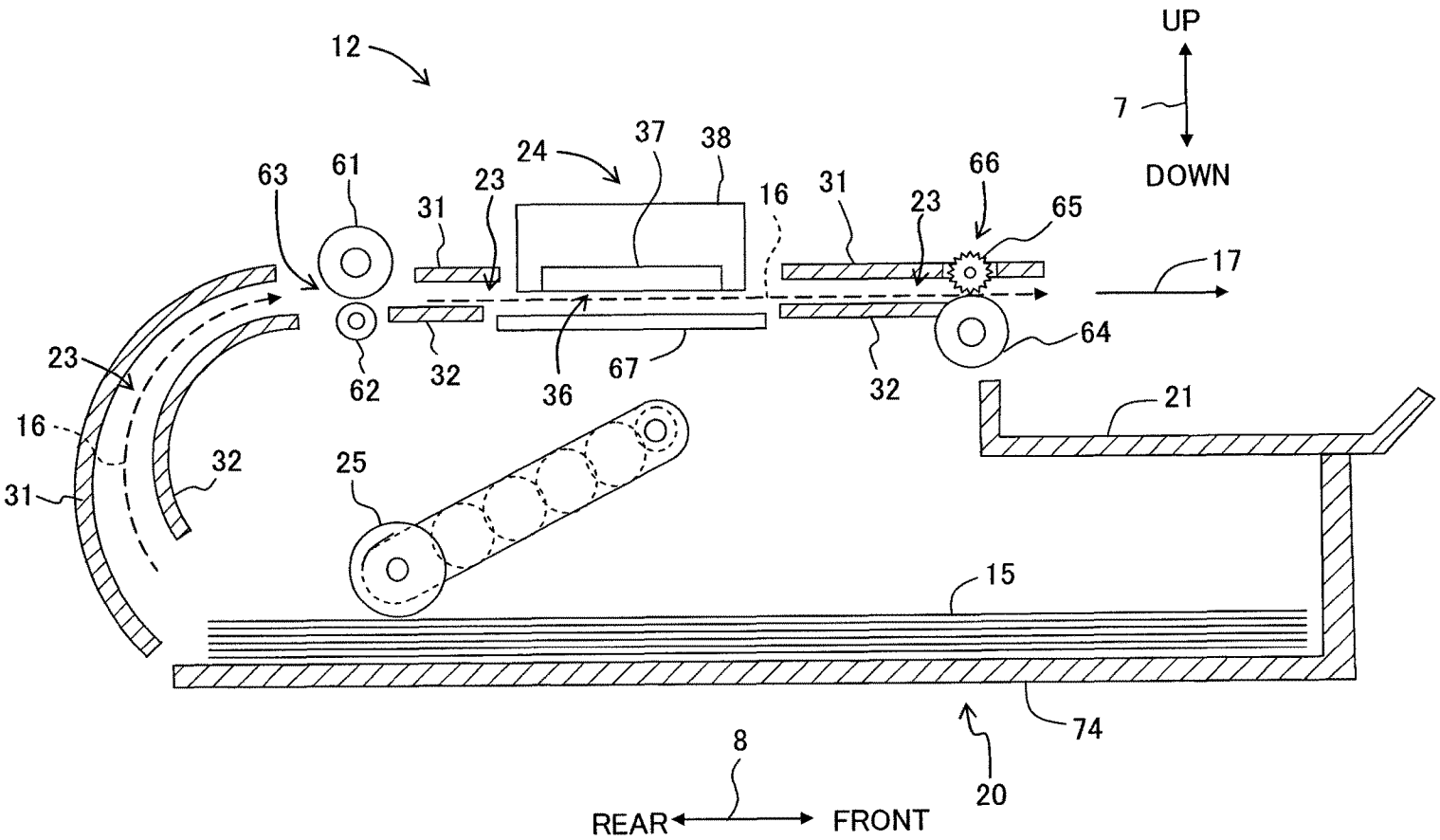
FIG. 2 is a vertical cross-sectional view depicting schematically an internal structure of a printer section 12.

As depicted in FIG. 2, at an interior of the casing 14, a feed tray 20 which is insertable and extractable in the front-rear direction through the opening 13, and in which the recording sheets 15 are accommodated, a discharge tray 21 (an example of a sheet tray of the present teaching) which is provided at an upper side of the feed tray 20, a pair of conveyance rollers 63 which convey the recording sheet 15 along a conveyance path, and a pair of discharge rollers 66, and a recording section 24 which records an image on the recording sheet 15 that is conveyed through the conveyance path 23 are installed. The recording sheet 15 having an image recorded thereon, is discharged to the discharge tray 21, and is supported by the discharge tray 21. Here, the discharge tray 21 is supported by the feed tray 20, and is inserted and extracted integrally with the feed tray 20 through the opening 13. The discharge tray 21 will be described later in detail.

Figure 3:
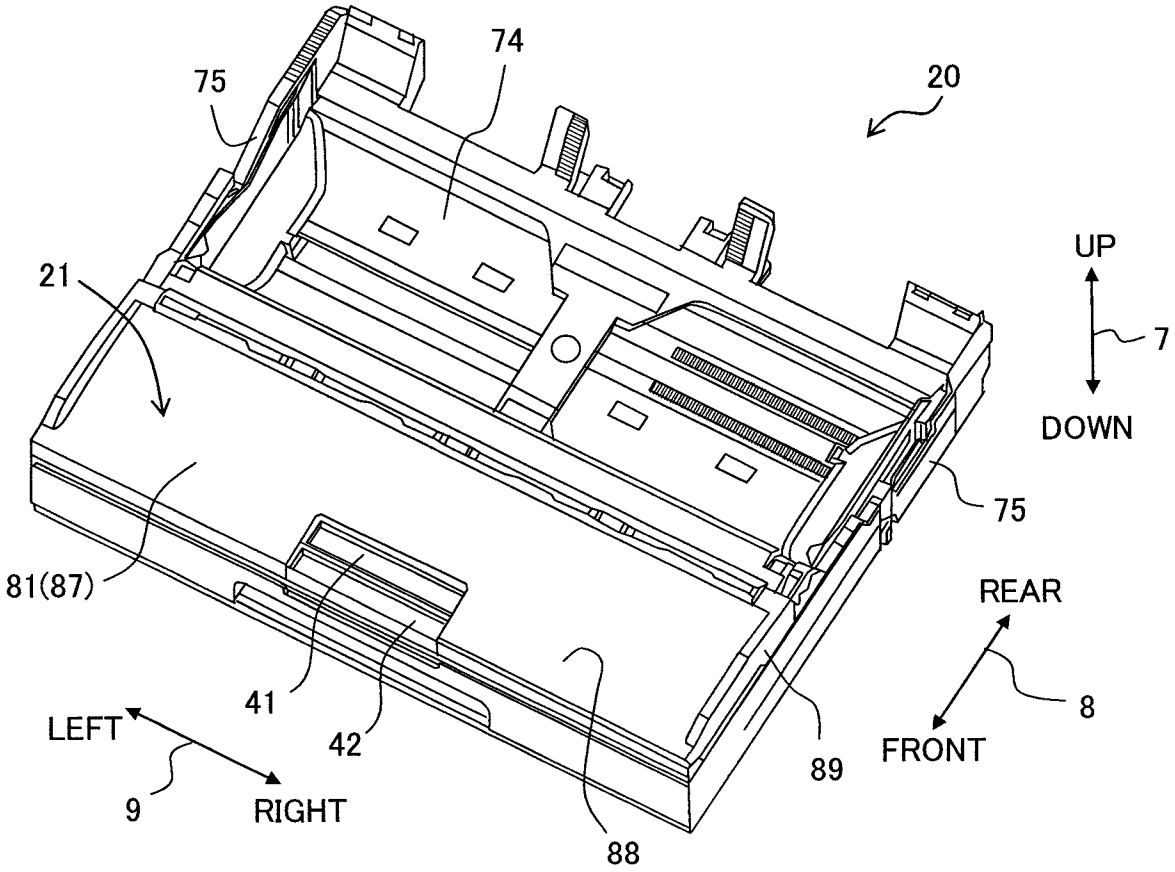
FIG. 3 is a perspective view of a feed tray 20.

As depicted in FIG. 3, the feed tray 20 includes a bottom plate 74 on which the recording sheet 15 is placed, and a pair of lateral plates 75 which are erected upward from a left end and a right end of the base plate 74. The recording sheet 15 placed on the bottom plate 74 is fed to the conveyance path 23 by a feed roller 25 (refer to FIG. 2).

As depicted in FIG. 2, the conveyance path 23 is extended upward from a lower side, with a rear end portion of the feed tray 20 as a base point, and then makes a U-turn, and is extended frontward to reach the discharge tray 21. The conveyance path 23 is a space formed by a first guide member 31 and a second guide member 32 which are arranged to face with each other with a predetermined gap or distance. The recording sheet 15 is fed to the conveyance path 23 from the feed tray 20, and is conveyed through the conveyance path 23 in a conveyance direction which is a direction indicated by dashed arrow marks in FIG. 2. In other words, the recording sheet 15 is conveyed upward from the lower side while making a U-turn, and is conveyed frontward and discharged to the discharge tray 21.

As depicted in FIG. 2, the pair of conveyance rollers 63 which includes a conveyance roller 61 and a pinch roller 62 is provided at an upstream side of the conveyance direction 16, of the recording section 24 in the conveyance path 23. The pinch roller 62 makes a pressed contact with a roller surface of the conveyance roller 61 by an elastic member (not depicted in the diagram) such as a spring. The pair of discharge rollers 66 which includes a discharge roller 64 and a spur 65 is provided at a downstream side of the conveyance direction 16, of the recording section 24 in the conveyance path 23. The spur 65 makes a pressed contact with a roller surface of the discharge roller 64 by an elastic member (not depicted in the diagram) such as a spring. The conveyance roller 61 and the discharge roller 64 are rotated by a driving force transmitted from a motor for conveying (not depicted in the diagram), and conveys the recording sheet 15 in the conveyance direction 16. While the recording sheet 15 is conveyed in the conveyance direction 16, the recording sheet 15 is pinched between the pinch roller 62 and the conveyance roller 61 and/or between the discharge roller 64 and the spur 65.

As depicted in FIG. 2, the recording section 24 is arranged at an upper side of the conveyance path 23. The recording section 24 includes a recording head 37 which is provided at a position that enables to face the conveyance path 23 and a carriage 38 on which the recording head 37 is mounted. A plurality of nozzles 36 for ejecting ink supplied from an ink cartridge (not depicted in the diagram) toward the conveyance path 23 is formed in the recording head 37. The carriage 38 is configured to be reciprocatable in the left-right direction. Ink droplets are ejected from the nozzles 36 toward the recording sheet 15 that is conveyed through the conveyance path 23 while the carriage 38 undergoes reciprocating movement. Accordingly, an image is formed on the recording sheet 15. In the embodiment, a method by which the recording section 24 records an image on the recording sheet 15 is an ink jet recording method. However, the method of recording is not restricted to the ink-jet recording method, and may be a method such as electrophotography. The platen 67 is arranged to face the lower surface of the recording head 37, and the platen 67 supports the recording sheet 15 conveyed through the conveyance path 23.

[Discharge Tray 21]

Figure 4:
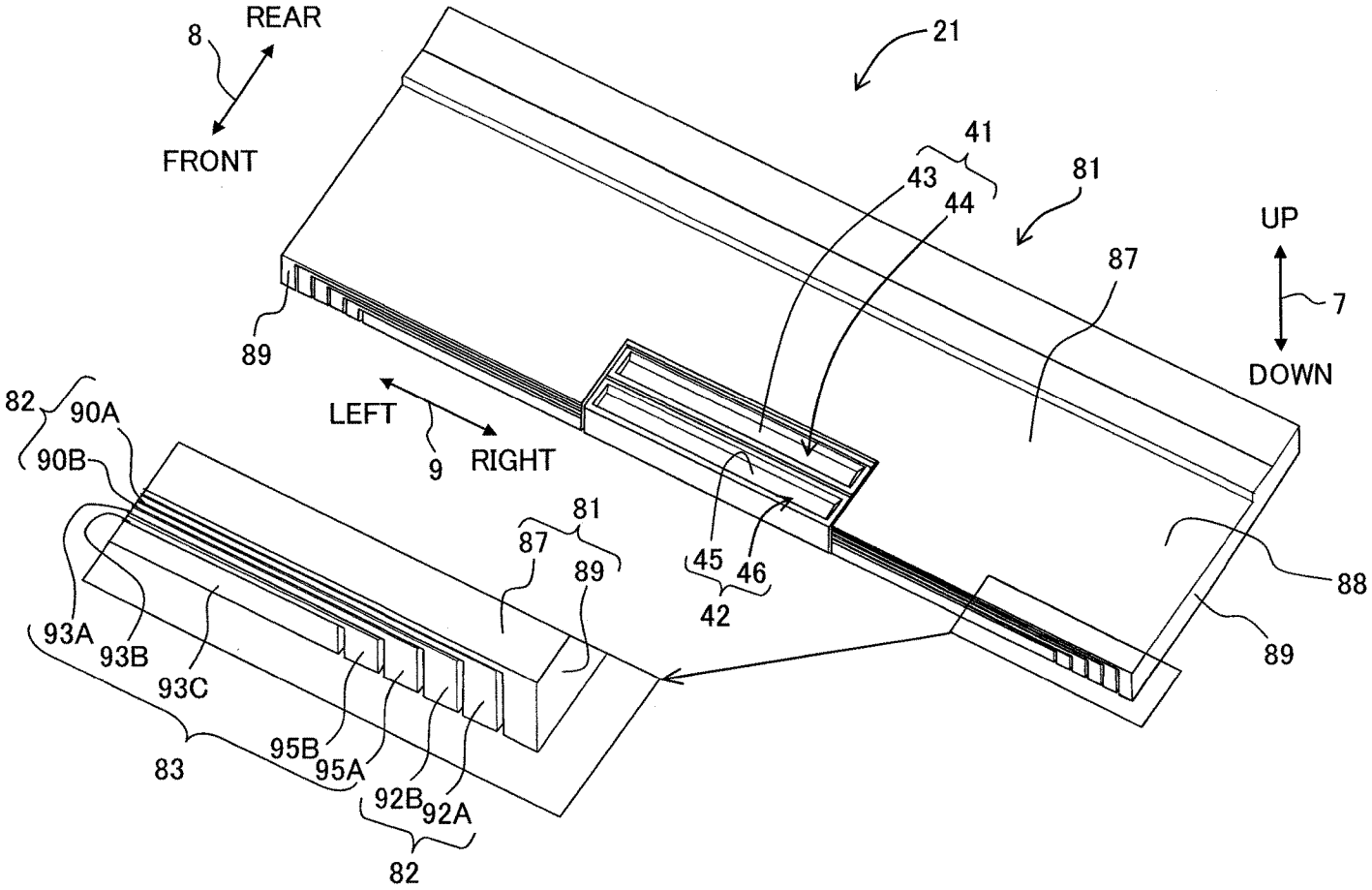
FIG. 4 is a perspective view of a discharge tray 21 in a state of a second receiving member 82 at a first position and a third receiving member 83 at a third position.

As depicted in FIG. 4, FIG. 6, and FIG. 8, the discharge tray 21 includes a first receiving member 81, a second receiving member 82 and a third receiving member 83. The second receiving member 82 is provided at a lower side of the first receiving member 81. Further, the third receiving member 83 is provided at a lower side of the second receiving member 82. As depicted in FIG. 3, a left end portion and a right end portion of the first receiving member 81 are supported by the lateral plate 75 of the feed tray 20. More elaborately, a pair of lateral plates 89 that will be described later is supported by the lateral plate 75 of the feed tray 20. The second receiving member 82 is supported to be movable in the front-rear direction 8 by the first receiving member 81, and is drawn frontward which is a discharge direction 17 (an example of a first direction of the present teaching, refer to FIG. 2) of the recording sheet 15 from the first receiving member 81, and is pushed rearward. The third receiving member 83 is supported to be movable in the front-rear direction 8 by the second receiving member 82, and is drawn frontward from the second receiving member 82 and pushed rearward.

As depicted in FIG. 5, the second receiving member 82 covers an upper side of the third receiving member 83, in a state of the third receiving member 83 pushed into the second receiving member 82. As depicted in FIG. 4, the first receiving member 81 covers an upper side of the third receiving member 83 and the second receiving member 82 positioned under the first receiving member 81, in a state of the second receiving member 82 pushed into the first receiving member 81, and the third receiving member 83 pushed into the second receiving member 82. Moreover, the second receiving member 82 covers the upper side of the third receiving member 83 positioned under the second receiving member 82.

Figure 5A:
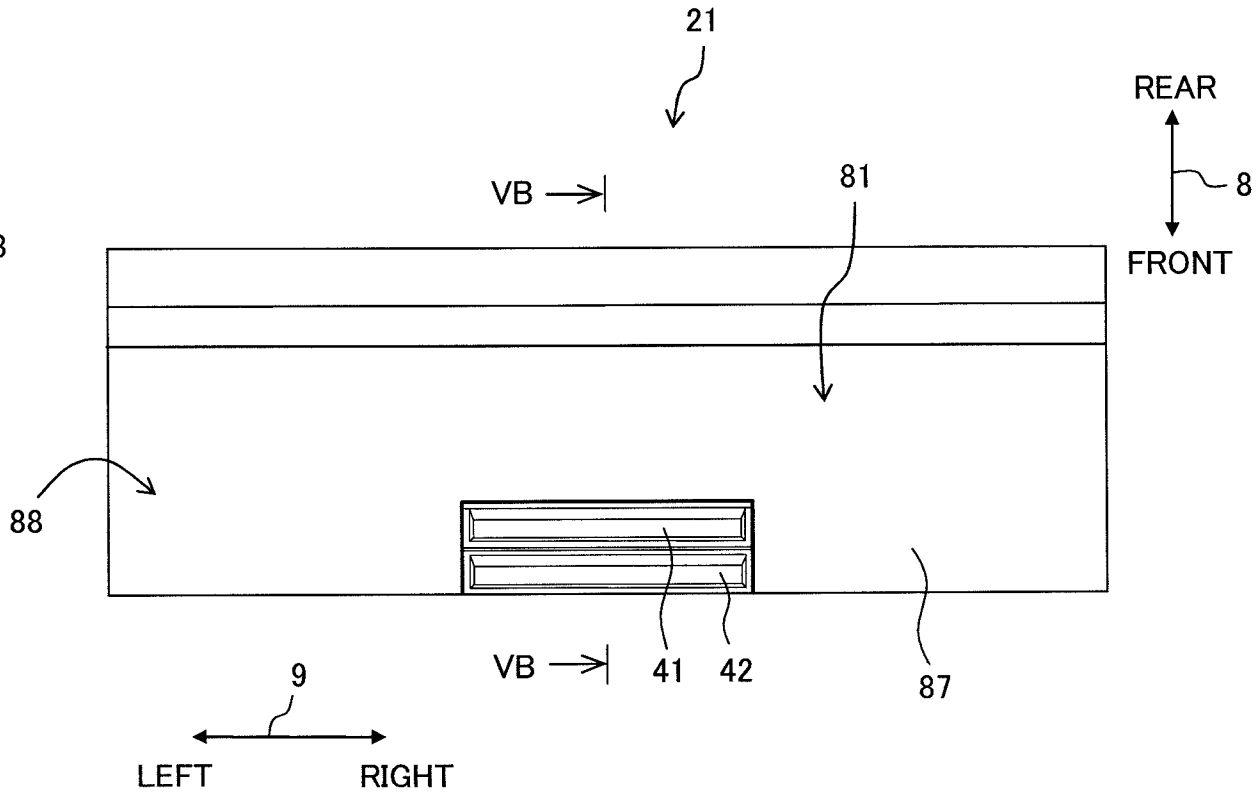
FIG. 5A is a plan view of the discharge tray 21 in FIG. 4.
Figure 5B:
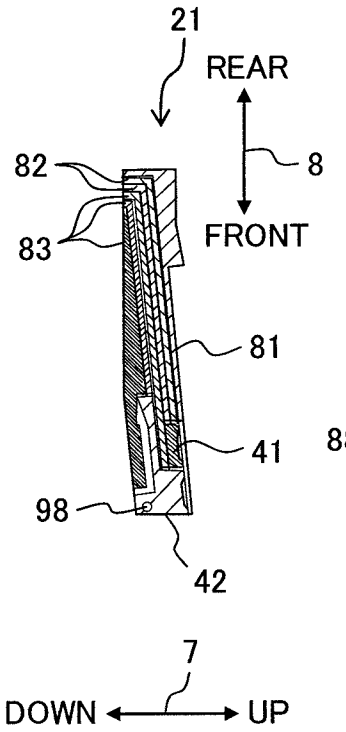
FIG. 5B is a cross-sectional view along a line VB-VB in FIG. 5A.

The discharge tray 21 is used in a state depicted in FIG. 4, FIG. 5A, and FIG. 5B in a case in which the image recording is carried out on the recording sheet 15 of a small size such as a post-card size. In other words, the discharge tray 21 supports the recording sheet 15 only by an upper surface 88 of a supporting plate 87 that will be described later, in the first receiving member 81, in a state of the third receiving member 83 pushed into the second receiving member 82, and the second receiving member 82 pushed into the first receiving member 81.

The discharge tray 21 is used in a state depicted in FIG. 6A, FIG. 6B, FIG. 7A and FIG. 7B when the image recording is carried out on the recording sheet 15 of a size such as A4. In other words, the discharge tray 21 supports the recording sheet 15 by the upper surface 88 and an upper surface 91 of a supporting plate 90 that will be described later, in the second receiving member 82, in a state that the second receiving member 82 is drawn out from the first receiving member 81 and the third receiving member 83 is pushed into the second receiving member 82.

The discharge tray 21 is used in a state depicted in FIG. 8A, FIG. 8B, FIG. 9A and FIG. 9B when the image recording is carried out on the recording sheet 15 of a size such as A3. In other words, the discharge tray 21 supports the recording sheet 15 by the upper surface 88, the upper surface 91, and an upper surface 94 of a supporting plate 93 that will be described later, in the third receiving member 83, in a state that the second receiving member 82 is drawn out from the first receiving member 81 and the third receiving member 83 is drawn out from the second receiving member 82.

In the state depicted in FIG. 4, a front end of the first receiving member 81 and a front end of the second receiving member 82 are located at a same plane. Moreover, in the state depicted in FIG. 4, FIG. 6A and FIG. 6B, the front end of the second receiving member 82 and a front end of the third receiving member 83 are located in a same plane. The abovementioned description is only an exemplification, and the front end of the first receiving member 81, the front end of the second receiving member 82 and the front end of the third receiving member 83 may not be located in the same plane in a state of being pushed into another receiving member such as the first receiving member 81, the second receiving member 82 and the third receiving member 83.

[First Receiving Member 81]

As depicted in FIG. 4, FIG. 5A and FIG. 5B, the first receiving member 81 includes a supporting plate 87 which is a member in the form of a plate of which thickness direction is parallel to the up-down direction 7, and the pair of lateral plates 89. One of the pair of lateral plates 89 is extended downward from a left end portion of the supporting plate 87, and the other of the pair of lateral plates 89 is extended downward from a right end portion of the supporting plate 87. The upper surface 88 (an example of a first supporting surface of the present teaching) of the supporting plate 87 is spread in the front-rear direction 8 and the left-right direction 9, and the recording sheet 15 discharged from the multi-function peripheral 10 is supported by the upper surface 88.

Figure 6B:
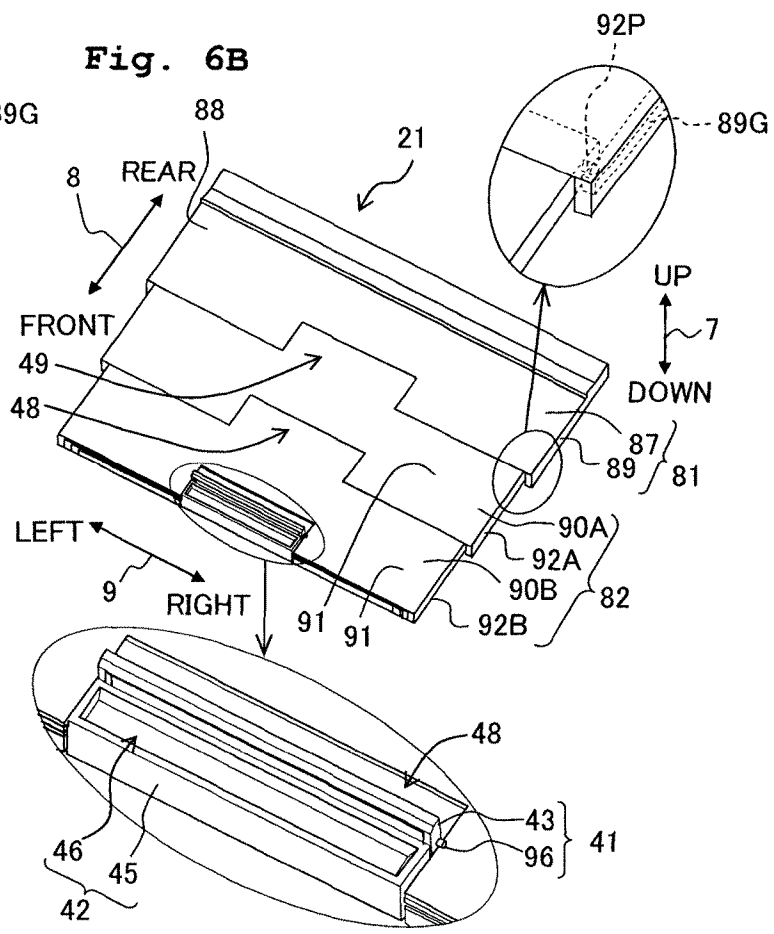
FIG. 6A and FIG. 6B are perspective views of the discharge tray 21 in a state of the second receiving member 82 at a second position and the third receiving member 83 at the third position.
Figure 6A:
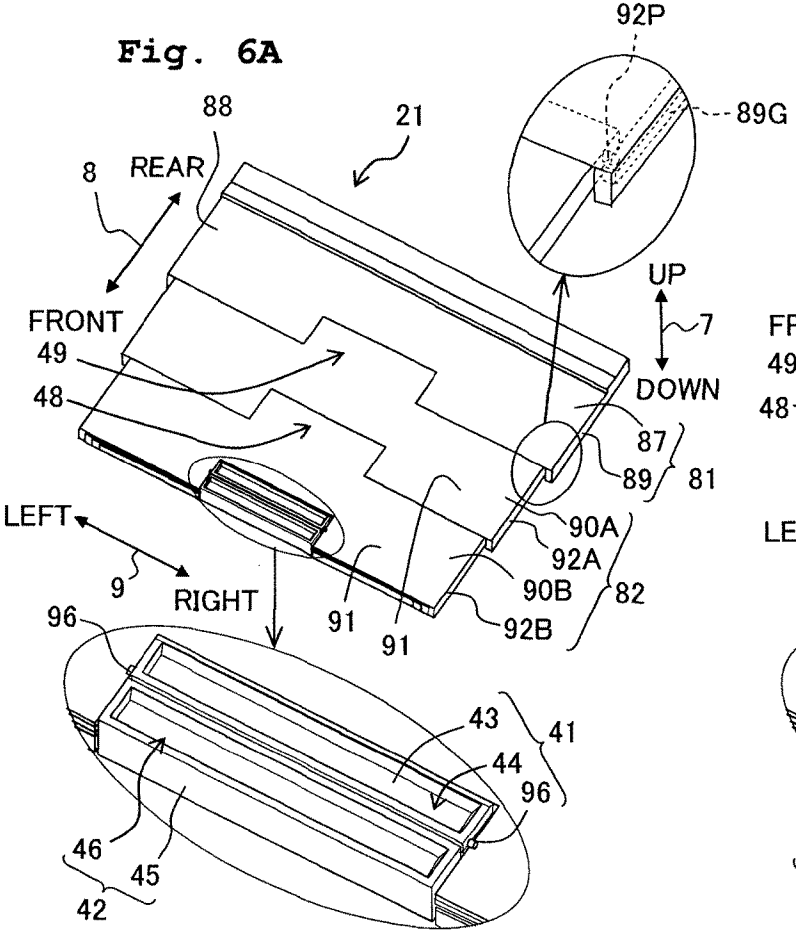
Figure 7A:
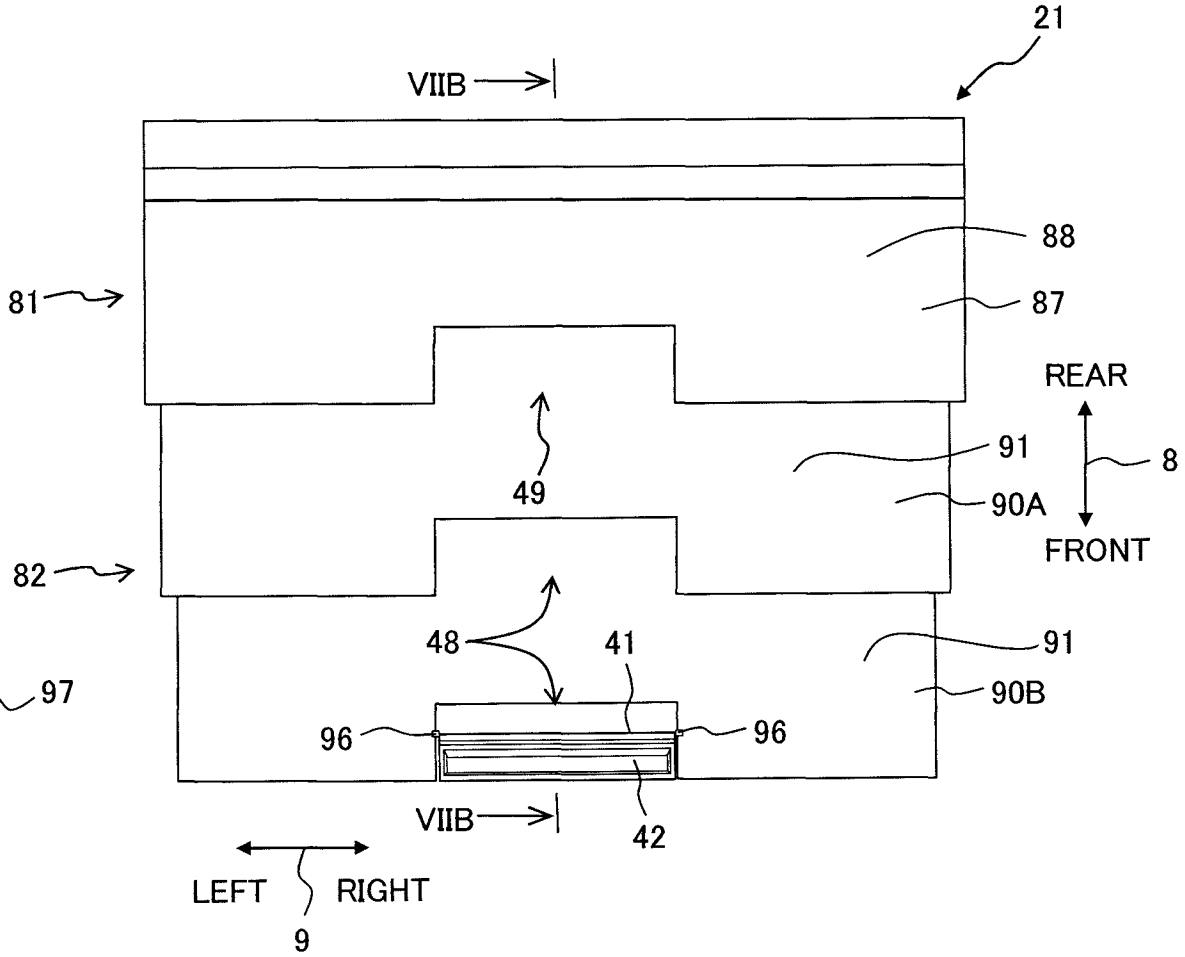
FIG. 7A is a plan view of the discharge tray 21 in FIG. 6B.
Figure 7B:
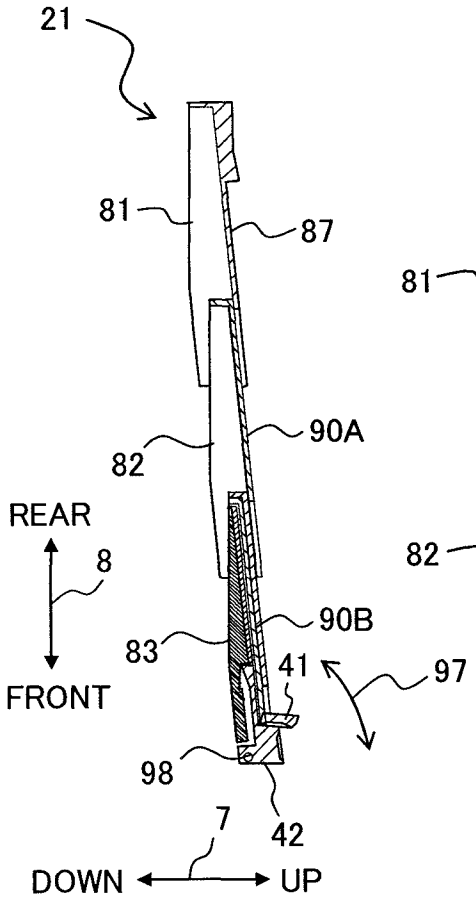
FIG. 7B is a cross-sectional view along a line VIIB-VIIB in FIG. 7A.

In the embodiment, an arrangement in which the first receiving member 81 movably supports the second receiving member 82 in the front-rear direction 8 is as follows. In other words, as depicted in FIGS. 6A and 6B, a groove 89G extended along substantially front-rear direction 8 from a vicinity of a rear end of the lateral plate 89 up to a vicinity of a front end of the lateral plate 89 is formed in a surface on an inner side in the left-right direction 9 in the pair of lateral plates 89. A protrusion 92P provided to a pair of lateral plates 92A of the second receiving member 82 that will be described later is inserted into the groove 89G. Note that the groove 89G and the protrusion 92P are omitted in the diagrams except for FIGS. 6A and 6B.

Moreover, as it will be described later, similar to the abovementioned configuration, the supporting plates 90A and 90B of the second receiving member 82 and the adjacent supporting plates 93A, 93B and 93C of the third receiving member 83 are supported with each other to be movable in the front-rear direction 8 by using the configuration of the grooves and the protrusions. These grooves and protrusion have a same configuration as the groove 89G and the protrusion 92P. Note that these grooves and protrusions are omitted in diagrams for simplifying the diagrams. An arrangement in which the supporting plates of the first receiving member 81, the second receiving member 82, and the third receiving member 83 are supported to be movable mutually in the front-rear direction 8 is not restricted to the configuration that includes the grooves and the protrusions, and other known configurations may be used.

[Second Receiving Member 82]

As depicted in FIG. 6A, FIG. 6B, FIG. 7A and FIG. 7B, the second receiving member 82 includes two supporting plates 90A and 90B which are members in the form of a plate of which thickness direction is parallel to the up-down direction 7, and a pair of lateral plates 92. One of the pair of lateral plates 92 is extended downward from a left end portion of the supporting plate 90, and the other of the pair of lateral plates 92 is extended downward from a right end portion of the supporting plate 90. Two pairs of lateral plates 92 (a pair of the lateral plates 92A and a pair of lateral plates 92B) are provided corresponding to each supporting plate 90. The supporting plate 90 may be one plate or more than two plates, and the pair of lateral plates 92 may be one pair of lateral plates 92 or more than two pairs of lateral plates 92.

The upper surface 91 (an example of a second supporting surface of the present teaching) of each supporting plate 90 is spread in the front-rear direction 8 and the left-right direction 9, and the recording sheet 15 discharged from the multi-function peripheral 10 is supported. In the state of the second receiving member 82 pushed into the first receiving member 81, the supporting plate 90A covers an upper side of the supporting plate 90B (refer to FIG. 4).

As depicted in FIG. 4, the pair of lateral plates 92A extended from the supporting plate 90A is provided corresponding to the pair of lateral plates 89 at an inner side of the pair of lateral plates 89, in the left-right direction. A protrusion (not depicted in the diagram) extended toward the pair of lateral plates 89 is provided to a rear end portion of a surface, of the pair of lateral plates 92A, facing the pair of lateral plates 89. The protrusion is inserted or fitted into a groove formed in the pair of lateral plates 89. The protrusion is supported by a surface which demarcates a lower side of the groove. A groove (not depicted in the diagram) which is extended along the substantially front-rear direction 8 from a vicinity of a rear end of the pair of lateral plates 92A up to a vicinity of a front end of the pair of lateral plates 92A is formed in a surface, of the pair of lateral plates 92A, on an inner side of the left-right direction 9.

The pair of lateral plates 92B extended from the supporting plate 90B is provided to be facing the pair of lateral plates 92A on an inner side of the pair of lateral plates 92A in the left-right direction 9. A protrusion (not depicted in the diagram) which is extended toward the pair of lateral plates 92A is provided to a rear end portion of a surface, of the pair of lateral plates 92B, facing the pair of lateral plates 92A. The protrusion is inserted or fitted into a groove formed in the pair of lateral plates 92A. The protrusion is supported by a surface demarcating a lower side of the groove. A groove (not depicted in the diagram) which is extended along the substantially front-rear direction 8 from a vicinity of a rear end of the pair of lateral plates 92B up to a vicinity of a front end of the pair of lateral plates 92B is formed in a surface, of the pair of lateral plates 92B, on an inner side of the left-right direction 9. The protrusion is formed to be extended in the front-rear direction 8 such that, the supporting plate 90 is not jounced or shaken in the up-down direction in a state of the protrusion fitted into the groove formed in the pair of lateral plate 92B.

According to the abovementioned configuration, when each protrusion is positioned at a rear end of the respective groove, or in other words, when the second receiving member 82 is pushed into the first receiving member 81 (refer to FIG. 4), in a plan view from the top, the entire upper surface 91 of the second receiving member 82 overlaps with the upper surface 88 of the first receiving member 81. A position of the second receiving member 82 at this time is a first position of the present teaching.

When each protrusion is positioned at a front end of the respective groove, or in other words, when the supporting plate 90B is drawn out from the supporting plate 90A, and the supporting plate 90A is drawn out from the first receiving member 81 (refer to FIG. 6A, FIG. 6B, FIG. 7A and FIG. 7B), in a plan view from the top, a rear end portion of the upper surface 91 of the supporting plate 90A overlaps with a front end portion of the upper surface 88 of the first receiving member 81. A position of the second receiving member 82 at this time is a second position of the present teaching. An overlapping area of a portion of the upper surface 91 of the second receiving member 82 with respect to the upper surface 88 of the first receiving member 81 when the second receiving member 82 is at the second position is smaller than an overlapping area of a portion of the upper surface 91 of the second receiving member 82 with respect to the upper surface 88 of the first receiving member 81 when the second receiving member 82 is at the first position. At this time, the third receiving member 83 is pushed into a lower side of the second receiving member 82.

[Third Receiving Member 83]

As depicted in FIG. 8A, FIG. 8B, FIG. 9A and FIG. 9B, the third receiving member 83 includes the three supporting plates 93A, 93B and 93C which are members in the form of a plate of which thickness direction is parallel to the up-down direction 7, and a pair of lateral plates 95. One of the pair of lateral plates 95 is extended downward from a left end portion of the supporting plates 93, and the other of the pair of lateral plates 95 is extended downward from a right end portion of the supporting plates 93. Two pairs of lateral plates 95 (a pair of lateral plates 95A and a pair of lateral plates 95B) are provided corresponding to the supporting plates 93A and 93B. A lateral plate 95 corresponding to the supporting plate 93C may be provided. There may be not more than two supporting plates 93 or may be four or more supporting plates 93, and the pair of lateral plates 92 may be one pair or more than two pairs of lateral plates 92.

The upper surface 94 (an example of a third supporting surface of the present teaching) of each supporting plate 93 is spread in the front-rear direction 8 and the left-right direction 9, and the recording sheet 15 discharged from the multi-function peripheral 10 is supported. In the state of the third receiving member 83 pushed into the second receiving member 82, the supporting plate 93A covers an upper side of the supporting plate 93B, and the supporting plate 93B covers an upper side of the supporting plate 93C (refer to FIG. 4).

The pair of lateral plates 95A extended from the supporting plate 93A is provided to be facing the pair of lateral plates 92B on an inner side of the pair of lateral plates 92B in the left-right direction. A protrusion (not depicted in the diagram) which is extended toward the pair of lateral plates 92B is provided to a rear end portion of a surface, of the pair of lateral plates 95A, facing the pair of lateral plates 92B. The protrusion is inserted or fitted into a groove formed in the pair of lateral plates 92B. The protrusion is supported by a surface demarcating a lower side of the groove. A groove (not depicted in the diagram) which is extended along the substantially front-rear direction 9 from a vicinity of a front end of the lateral plate 95A up to a vicinity of a front end of the lateral plate 95A is formed in a surface, of the pair of lateral plates 95A, on an inner side of the left-right direction.

The pair of lateral plates 95B extended from the supporting plate 93B is provided to be facing the pair of lateral plates 95A on an inner side of the pair of lateral plates 95A. A protrusion (not depicted in the diagram) extended toward the pair of lateral plates 95A is provided to a rear end portion of a surface of the pair of lateral plates 95B facing the pair of lateral plates 95A. The protrusion is inserted or fitted into a groove formed in the pair of lateral plates 95A. The protrusion is supported by a surface demarcating a lower side of the groove. A groove (not depicted in the diagram) extended along substantially front-rear direction 8 from a vicinity of a rear end of the lateral plate 95B up to a vicinity of a front end of the lateral plate 95B is formed in a surface, of the pair of lateral plates 95B, on an inner side in the left-right direction 9. The protrusion is formed to be extended in the front-rear direction 8 such that, the supporting plate 93B is not jounced or shaken in the up-down direction in a state of the protrusion fitted into the groove formed in the pair of lateral plates 95A.

A protrusion (not depicted in the diagram) extended toward the pair of lateral plates 95B is provided to a rear end portion of a left side surface and a right side surface of the supporting plate 93C. The protrusion is inserted into the groove formed in the pair of lateral plates 95B. The projection is supported by a surface demarcating a lower side of the groove.

According to the abovementioned configuration, when each protrusion is positioned at a rear end of the respective groove, or in other words, when the third receiving member 83 is pushed into the second receiving member 82 (refer to FIG. 4), in a plan view from the top, the entire upper surface 94 of the third receiving member 83 overlaps with the upper surface 91 of the second receiving member 82. A position of the third receiving member 82 at this time is a third position of the present teaching.

When each protrusion is positioned at a front end of the respective groove, or in other words, when the supporting plate 93C is drawn out from the supporting plate 93B, the supporting plate 93B is drawn out from the supporting plate 93A, and the supporting plate 93A is drawn out from the second receiving member 82 (refer to FIG. 8), in a plan view from the top, a rear end portion of the upper surface 94 of the supporting plate 93A overlaps with a front end portion of the upper surface 91 of the second receiving member 82. A position of the third receiving member 83 at this time is a fourth position of the present teaching. As depicted in FIG. 9, an overlapping area of a portion of the upper surface 94 of the third receiving member 83 with respect to the upper surface 91 of the second receiving member 82 when the third receiving member 83 is at the fourth position is smaller than an overlapping area of a portion of the upper surface 94 of the third receiving member 83 with respect to the upper surface 91 of the second receiving member 82 when the third receiving member 83 is at the third position.

[First Holding Portion 41 and Second Holding Portion 42]

As depicted in FIG. 4, a first holding portion 41 is formed in the second receiving member 82. The first holding portion 41 is provided at a central portion of the upper surface 91 in the left-right direction 9, and moreover, is provided at a front end portion of the upper surface 91 in the front-rear direction 8. The first holding portion 41 includes a first rotation stopper 43, and a recess 44 provided to the first rotation stopper 43.

The first rotation stopper 43 is pivotably installed on the supporting plate 90B. This will be described below in detail. As depicted in FIG. 6A and FIG. 6B, a notch 48 which is cutout rearward from a front end of the supporting plate 90B is provided to the supporting plate 90B. Moreover, a protrusion 96 is provided to a right side surface and a left side surface of the first rotation stopper 43. The protrusion 96 is inserted into a hole (not depicted in the diagram) that is formed into a right side surface and a left side surface of the notch 48. Accordingly, the first rotation stopper 43 is pivoted in a direction of an arrow mark 97 (refer to FIG. 7B), between a fallen or collapsed posture (Refer to FIG. 6A) of being fallen with respect to the second receiving member 82, with the protrusion 96 as a shaft, and an erected posture (refer to FIG. 6B). As depicted in FIG. 4, the recess 44 is dented downward from an upper surface of the first rotation stopper 43 in the fallen posture. The recess 44 has a size that enables a user of the multi-function peripheral 10 to insert a finger therein.

Figure 8B:
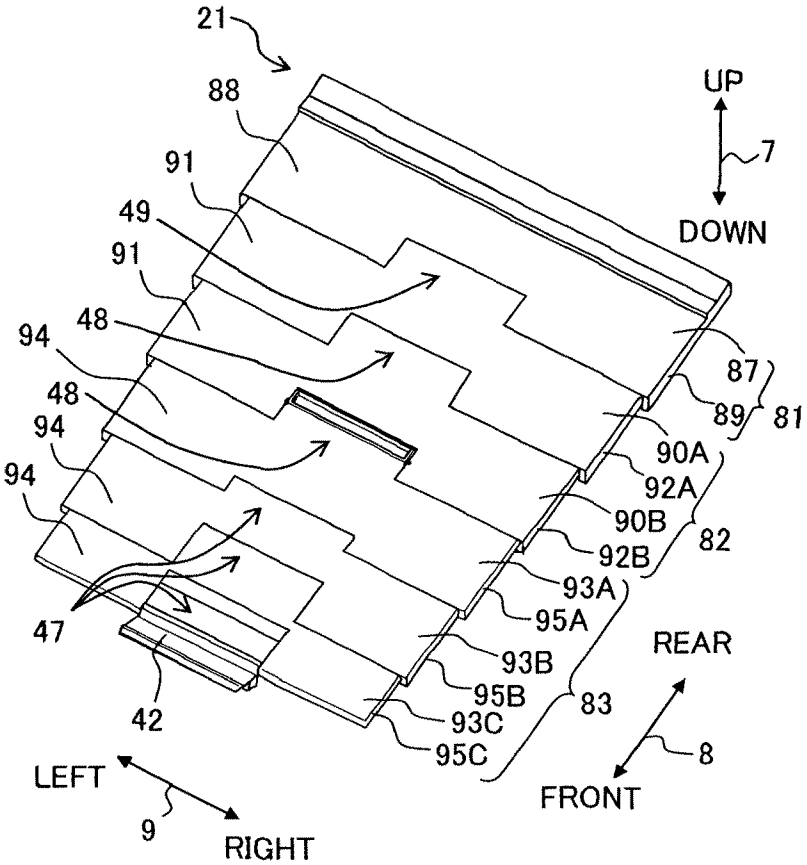
FIGS. 8A and 8B are perspective views of the discharge tray 21 in a state of the second receiving member 82 at the second position and the third receiving member 83 at a fourth position.
Figure 8A:
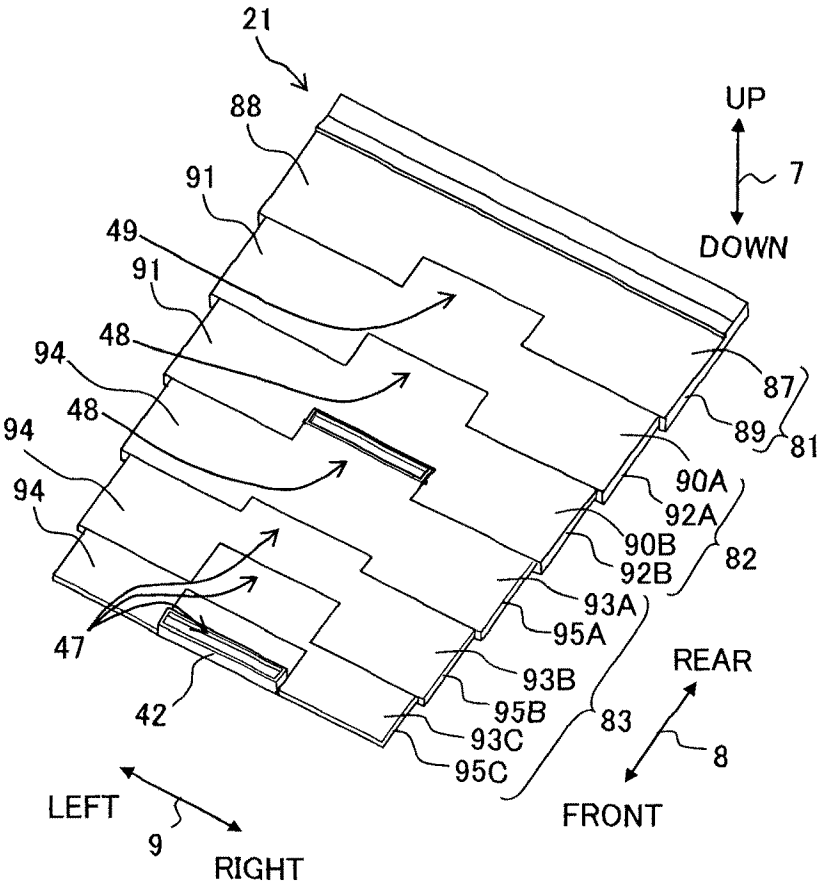
Figure 9B:
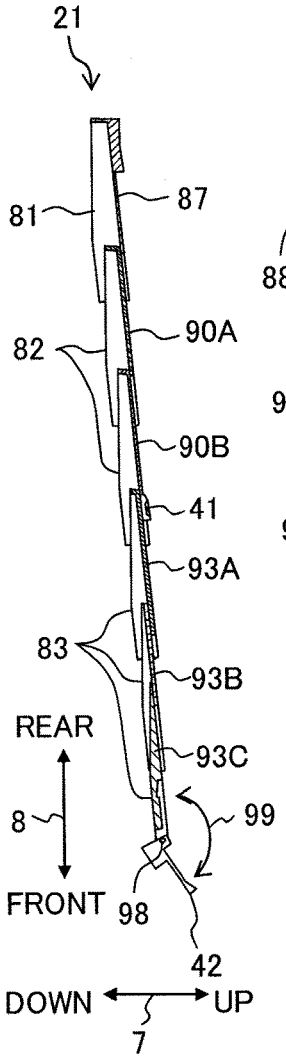
FIG. 9B is a cross-sectional view along a line IXB-IXB in FIG. 9A.
Figure 9A:
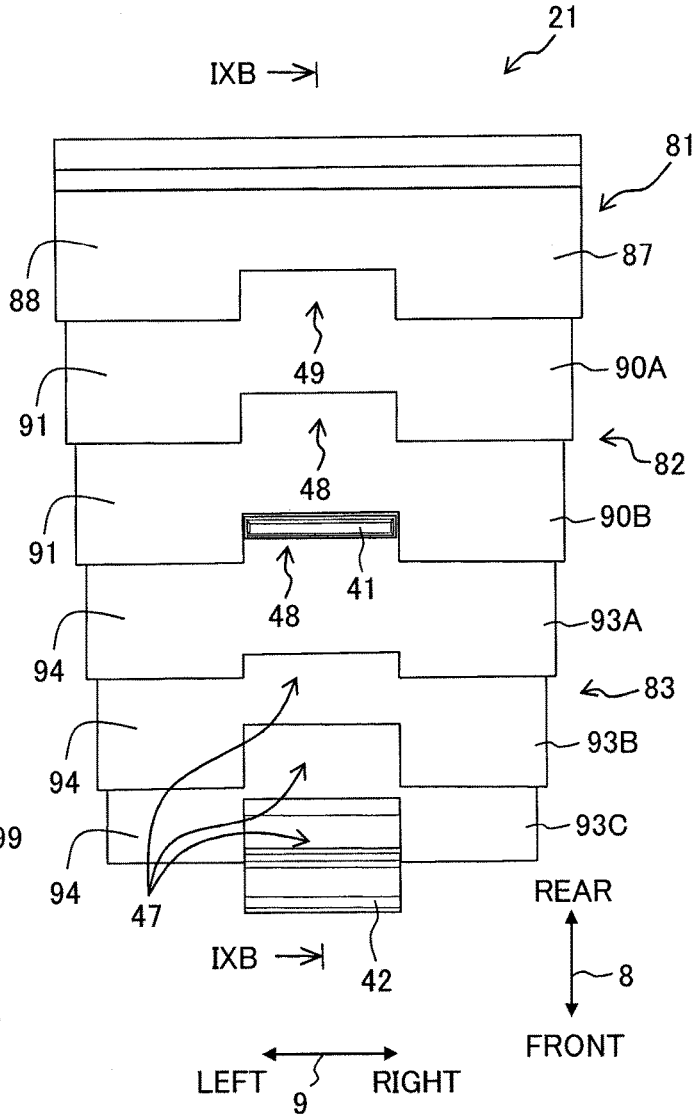
FIG. 9A is a plan view of the discharge tray 21 in FIG. 8B.

As depicted in FIG. 8A and FIG. 8B, a second holding portion 42 is formed in the third receiving member 83. The second holding portion 42 is provided at a central portion of the upper surface 94 in the left-right direction 9, and moreover at a front end portion of the upper surface 94 in the front-rear direction 8. The second holding portion 42 includes a second rotation stopper 45, and a recess 46 provided in the second rotation stopper 45.

The second rotation stopper 45 is pivotably installed on the supporting plate 93, similarly as the first rotation stopper 43. In other words, a protrusion 96 provided to a left side surface and a right side surface of the second rotation stopper 45 (refer to FIG. 7B and FIG. 9B) is inserted into a hole (not depicted in the diagram) formed in a right side surface and a left side surface of a notch 47 which is provided in the supporting plate 93 and will be described later. Accordingly, the second rotation stopper 45 is pivoted in a direction of an arrow mark 99 (refer to FIG. 9B), between a fallen posture (refer to FIG. 8A) of being fallen with respect to the third receiving member 83, with the protrusion 98 as a shaft, and an erected posture (refer to FIG. 8B). As depicted in FIG. 4, the recess 46 is dented downward from an upper surface of the second rotation stopper 45 in the fallen posture. The recess 46 has a size that enables the user of the multi-function peripheral 10 to insert a finger therein.

The first holding portion 41 and the second holding portion 42 are not restricted to the configuration that includes the first rotation stopper 43, the second rotation stopper 45, and the recesses 44 and 46, provided that the user is capable of drawing out the second receiving member 82 and the third receiving member 83 from the first receiving member 83, or is capable of pushing the second receiving member 82 and the third receiving member 83 into the first receiving member 83. For instance, the first holding portion 41 and the second holding portion 42 may be made only of the recesses 44 and 46 respectively, formed in the upper surfaces 91 and 94 of the second receiving member 82 and the third receiving member 83 respectively, and the first rotation stopper 43 and the second rotation stopper 45 may not be provided. Moreover, the first holding portion 41 and the second holding portion 42 may include a protrusion protruding upward, which the user of the multi-function peripheral 10 can hold, instead of the recesses 44 and 46.

As depicted in FIG. 4, the first holding portion 41 and the second holding portion 42 are arranged almost at the same position in the left-right direction 9 (an example of a width direction of the present teaching), or in other words, at positions overlapping mutually at almost all portions in the left-right direction 9. The first holding portion 41 and the second holding portion 42 may have a positional relationship of overlapping mutually only partially. As depicted in diagrams from FIG. 4 to FIG. 9B, the first holding portion 41 is provided at a rearward side (upstream side of the discharge direction) irrespective of the positions of the second receiving member 82 and the third receiving member 83.

[Notches 47 to 49]

As depicted in FIG. 8A, FIG. 8B, FIG. 9A and FIG. 9B, the supporting plate 93 of the third receiving member 83 has the notch 47 dented rearward along the front-rear direction 8 from a front end thereof. The notch 47 is provided at a position same as a position of the second holding portion 42 in the left-right direction 9. Moreover, the notch 47 is dented up to a position directly above the second holding portion 42 when the third receiving member 83 is at the third position, in the front-rear direction 8. Accordingly, as depicted in FIG. 6A, FIG. 6B, FIG. 7A and FIG. 7B, in a case in which the second receiving member 82 is visible from the top when the third receiving member 83 is at the third position, the second holding portion 42 is visible through the notch 47 and a notch 48 which will be described later. In other words, the second holding portion 42 is exposed from the notch 47 as viewed from above.

As depicted in FIG. 8A, FIG. 8B, FIG. 9A and FIG. 9B, each supporting plate 90 of the second receiving member 82 has the notch 48 which is dented rearward along the front-rear direction 8 from the front end of the supporting plate 90. The notch 48 is provided at the same position in each of the first holding portion 41 and the second holding portion 42, in the left-right direction. Moreover, the notch 48 is dented up to a position directly above the second holding portion 42 when the third receiving member 83 is at the third position, which is a position directly above the first holding portion 41 when the second receiving member 82 is at the first position. Accordingly, as depicted in FIG. 6A, FIG. 6B, FIG. 7A and FIG. 7B, in a case in which the second receiving member 82 is visible from the top when the third receiving member 83 is at the third position, the second holding portion 42 is visible through the notches 47 and 48. Moreover, as depicted in FIG. 4, FIG. 5A and FIG. 5B, in a case in which the first receiving member 81 is visible from the top when the second receiving member 82 is at the first position, the first holding portion 41 is visible through the notches 47 and 48, and a notch 49 which will be described later.

As depicted in FIG. 8A, FIG. 8B, FIG. 9A and FIG. 9B, the supporting plate 87 of the first receiving member 81 has the notch 49 which is dented rearward along the front-rear direction 8 from the front end of the supporting plate 87. The notch 49 is provided at the same position in each of the first holding portion 41 and the second holding portion 42, in the leftward-rearward direction 9. Moreover, the notch 49 is dented up to a position directly above the first holding portion 41 when the second receiving member 82 is at the first position and the third receiving member 83 is at the third position, in the front-rear direction 8. Accordingly, as depicted in FIG. 4, FIG. 5A and FIG. 5B, in a case in which the first receiving member 81 is visible from the top when the second receiving member 82 is at the first position and the third receiving member 83 is at the third position, the first holding portion 41 and the second holding portion 42 are visible through the notches 47, 48 and 49. In other words, the first holding portion 41 and the second holding portion 42 are exposed from the notch 49 as viewed from upward.

[Drawing-Out Operation]

In a state depicted in FIG. 4, FIG. 5A and FIG. 5B, an operation of drawing the second receiving member 82 out from the first receiving member 81 by holding the first holding portion 41 by the user of the multi-function peripheral 10 will be described below. Further, an operation of drawing the second receiving member 82 and the third receiving member 83 from the first receiving member 81 by holding the second receiving portion 42 by the user of the multi-function peripheral 10 will be described below.

As the user inserts a finger from above in the recess 44 of the first holding portion 41 and moves the second receiving member 82 frontward, as depicted in FIG. 6A, FIG. 6B, FIG. 7A and FIG. 7B, the supporting plates 90A and 90B of the second receiving member 82 are drawn out from the first receiving member 81, and the second receiving member 82 moves from the first position to the second position. At this time, the movement of the second receiving member 82 is not hindered by the user's finger touching the first receiving member 81 and the supporting plate 90A provided at an upper side of the supporting plate 90B. This is because, the user's finger can go passed the front end of each of the first receiving member 81 and the second receiving member 82 through a space formed by the notches 48 and 49. In other words, due to the notches 48 and 49, the second receiving member 82 is maintained in a state of being capable of moving from the first position to the second position. Moreover, at this time, the third receiving member 83 moves integrally with the second receiving member 82, and the third receiving member 83 also stops when the second receiving member 82 has stopped upon reaching the second position.

As aforementioned, as the user moves the second receiving member 82 frontward by holding the first holding portion 41, the second receiving member 82 moves from the first position to the second position, and the third receiving member 83 maintains the third position. As a result, the recording sheet 15 discharged from the multi-function peripheral 10 is supported by the upper surface 88 of the first receiving member 81 and the upper surface 91 of the second receiving member 82.

Whereas, as the user inserts a finger from above in the recess 46 of the second holding portion 42 and moves the third receiving member 83 forward, the third receiving member 83 is drawn out from the second receiving member 82, and moves from the third position to the fourth position. At this time, the second receiving member 82 is still retained at the first position. Moreover, at this time, the movement of the third receiving member 83 is not hindered by the user's finger touching the first receiving member 81, the second receiving member 82 and the supporting plates 93A and 93B provided at an upper side of the supporting plate 93C. This is because, the user's finger can go passed the front end of each of the first receiving member 81 and the second receiving member 82 through a space formed by the notches 47, 48 and 49. In other words, due to the notches 47, 48 and 49, the third receiving member 83 is maintained in a state of being capable of moving from the third position to the fourth position. Next, as the user moves the third receiving member 83 frontward, the second receiving member 82 is pulled by the third receiving member 83, and moves frontward integrally with the third receiving member 83. Accordingly, as depicted in FIG. 8A, FIG. 8B, FIG. 9A and FIG. 9B, the second receiving member 82 is drawn out from the first receiving member 81, and moves from the first position to the second position.

As aforementioned, as the user holds the second holding portion 42 and moves the third receiving member 83 frontward, the third receiving member 83 moves from the third position to the fourth position, and the second receiving member 82 moves from the first position to the second position. As a result, the recording sheet 15 discharged from the multi-function peripheral 10 is supported by the upper surfaces 88, 91 and 94 of the first receiving member 81, the second receiving member 82 and the third receiving member 83 respectively.

Effect of the Embodiment

According to the present embodiment, as the user moves the second receiving member 82 frontward by holding the first holding portion 41, the second receiving member 82 is drawn out from the first receiving member 81, and moves from the first position to the second position. At this time, the third receiving member 83 moves forward integrally with the second receiving member 82. In other words, the third receiving member 83 does not move relative to the second receiving member 82, because the third receiving member 83 is not touched by the user. Accordingly, when the user moves the second receiving member 82 to the second position by holding the first holding portion 41, the surface of the discharge tray 21 supporting the recording sheet 15 is formed by the upper surface 88 and the upper surface 91.

Whereas, as the user moves the third receiving member 83 frontward by holding the second holding portion 42, the third receiving member 83 is drawn out from the second receiving member 82, and moves from the third position to the fourth position. Moreover, as the user moves the third receiving member 83 further frontward, the second receiving member 82 moves frontward integrally with the third receiving member 83. As a result, the second receiving member 82 is drawn out from the first receiving member 81, and moves from the first position to the second position. Accordingly, when the third receiving member 83 is moved frontward by the user by holding the second holding portion 42, the third receiving member 83 moves to the fourth position, and the second receiving member 82 moves to the second position. As a result, the surface of the discharge tray 21 supporting the recording sheet 15 is formed by the upper surfaces 88, 91 and 94.

As aforementioned, according to the present embodiment, it is possible to change a size of the surface supporting the recording sheet 15 in accordance with the first holding portion 41 and the second holding portion 42 held by the user. Concretely, by the user holding and moving frontward the first holding portion 41, it is possible to make the size of the surface supporting the recording sheet 15 suitable for supporting the recording sheet 15 of a predetermined size. Further, by the user holding and moving forward the second holding portion 42, it is possible to make the size of the surface supporting the recording sheet 15 suitable for supporting the recording sheet 15 of a size larger than the predetermined size. In other words, the user is able to form a supporting surface of a suitable size in accordance with the size of the recording sheet 15 just by selecting from plurality the first holding portion 41 and the second holding portion 42, or in other words, without taking any trouble.

Moreover, according to the present embodiment, since the notch 47 has been provided, it is possible to carry out the movement of the third receiving member 83 from the third position to the fourth position without the first receiving member 81 and the second receiving member 82 being hindered. Moreover, since the notch 48 has been provided, it is possible to carry out the movement of the second receiving member 82 from the first position to the second position without the first receiving member 81 being hindered.

Furthermore, according to the present embodiment, in the state depicted in FIG. 8A and FIG. 8B, the third receiving member 83 assumes a position lower than the second receiving member 82, and the first receiving member 81 assumes a position lower than the second receiving member 82. Accordingly, it is possible to prevent the recording sheet 15 discharged from the multi-function peripheral 10 from getting snagged on at a stepped edge portions of the first receiving member 81, the second receiving member 82, and the third receiving member 83.

According to the present embodiment, the first holding portion 41 is provided at a rear side of the second holding portion 42. Therefore, the user can make a judgment intuitively that it is possible to enlarge the supporting surface for the recording sheet by drawing out the third receiving member 83 by holding the second holding portion 42, rather than drawing out the second receiving member 82 by holding the first holding portion 41. In other words, the first holding portion 41 is provided at a rear side of the second holding portion 42, the user can make a judgment intuitively that it is possible to draw out the second receiving member 82 and the third receiving member 83 as a whole by drawing out the third receiving member 83 by holding the second holding portion 42.

Moreover, according to the present embodiment, the first holding portion 41 and the second holding portion 42 are made to overlap in the left-right direction 9, and are provided at mutually close positions. Therefore, it is possible to carry out easily, the selection of one of the first holding portion 41 and the second holding portion to be held.

Furthermore, according to the present embodiment, the first holding portion 41 and the second holding portion 42 are provided at a central portion in the left-right direction 9. Therefore, at the time of drawing the second receiving member 82 and the third receiving member 83 out by holding either the first holding portion 41 or the second holding portion 42, it is possible to draw out the second receiving member 82 and the third receiving member 83 straight without being inclined. In other words, it is possible to lower the possibility of the second receiving member 82 and the third receiving member 83 getting snagged on other members by being inclined.

According to the present embodiment, by erecting the first rotation stopper 43 and the second rotation stopper 45, it is possible to lower the possibility of the recording sheet 15 supported by the discharge tray 21 falling down from the discharge tray 21. Moreover, since the first rotation stopper 43 and the second rotation stopper 45 are provided to the first holding portion 41 and the second holding portion 42, the user is able to carry out the operation of drawing out the second receiving member 82 and the third receiving member 83 by holding the first holding portion 41 and the second holding portion 42, and the operation of pivoting the first rotation stopper 43 and the second rotation stopper 45.

Modifications

In the abovementioned embodiment, the first holding portion 41 and the second holding portion 42 are held from a side of the upper surfaces 88 and 91 by inserting a finger into the recesses 44 and 46 from above. However, the first holding portion 41 and the second holding portion 42 may be held from a side of the lower surface. In this case, the first holding portion 41 and the second holding portion 42 are exposed, as viewed from downward, from the notches 47, 48 and 49 provided in the first receiving member 81, the second receiving member 82 and the third receiving member 83, respectively. In other words, the second holding portion 42 is exposed from one of the first receiving member 81 and the second receiving member 82 which is positioned near the second holding portion 42 of the third receiving member 83 at the third position. The first holding portion 41 is exposed from one of the first receiving member 81 and the second receiving member 82 which is positioned near the first holding portion 41 of the second receiving member 82 at the first position. The one of the first receiving member 81 and the second receiving member 82 which is positioned near the second holding portion 42 of the third receiving member 83 at the third position can be positioned in upward side or downward side of the second holding portion 42. Similarly, the one of the first receiving member 81 and the second receiving member 82 which is positioned near the first holding portion 41 of the second receiving member 82 at the first position can be positioned in upward side or downward side of the first holding portion 41.

Moreover, in the abovementioned embodiment, the first receiving member 81 has been provided at an upper side of the second receiving member 82, and the second receiving member 82 has been provided at an upper side of the third receiving member 83. However, the order of arrangement in the up-down direction 7 of the first receiving member 81, the second receiving member 82 and the third receiving member 83 is not restricted to such order. For instance, the third receiving member 83 may be provided at the upper side of the second receiving member 82, and the second receiving member 82 may be provided at the upper side of the first receiving member 81. In this case, the third receiving member 83, which is at the uppermost position, covers the upper side of the first receiving member 81 and the second receiving member 82.

Moreover, even in a case in which the order of arrangement differs from the order of arrangement in the abovementioned embodiment, it is needless to mention that the notches 47, 48 and 49 are to be provided to the first receiving member 81, the second receiving member 82 and the third receiving member 83 respectively, to expose the first holding portion 41 and the second holding portion 42. In other words, the notches 49 and 48 are formed on one of the first receiving member 81 and the second receiving member 82 which is positioned near the second holding portion 42 (more elaborately, one of the upward side and the downward side to which the second holding portion is to be exposed) of the third receiving member 83 at the third position. Moreover, the notches 49 and 47 are formed on one of the first receiving member 81 and the third receiving member 83, the receiving member which is positioned near the first holding portion 41 (more elaborately, which is positioned one of the upward side and the downward side to which the first holding portion 41 is to be exposed) of the second receiving member 82 at the first position.

Moreover, in the abovementioned embodiment, the notches 47, 48 and 49 are formed in the first receiving member 81, the second receiving member 82 and the third receiving member 83. Thereby, each of the first holding portion 41 and the second holding portion 42 is exposed from one of the notches 47, 48 and 49. However, the first holding portion 41 and the second holding portion 42 may be exposed by means other than recess. For instance, in a case in which the third receiving member 83 is provided at the upper side of the first receiving member 81 and the second receiving member 82, an opening may be provided in the supporting plate 93 of the third receiving member 83. The first holding portion 41 and the second holding portion 42 may be exposed through the opening provided.

Figure 10A:
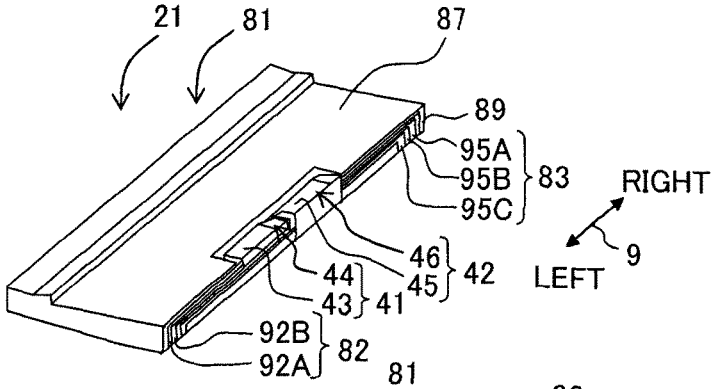
FIG. 10A, FIG. 10B and FIG. 10C are plan views of the discharge tray 21 in a modified example in which second holding portions are side-by-side in a left-right direction.
Figure 10B:
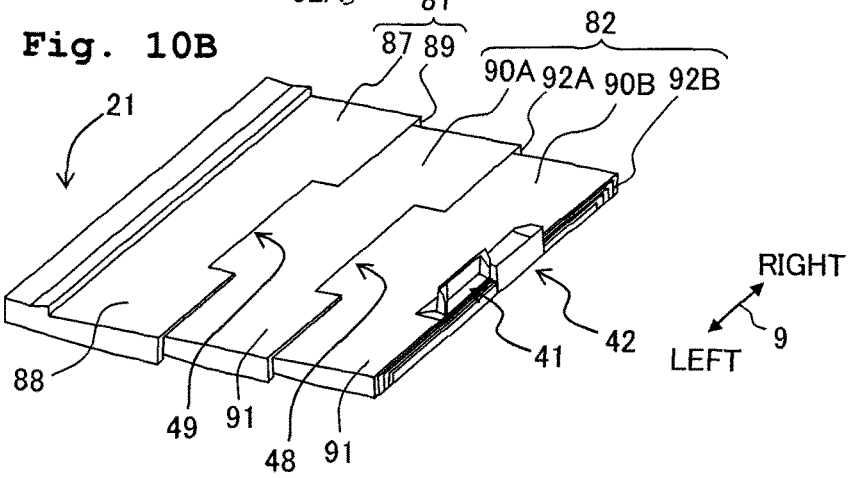
Figure 10C:
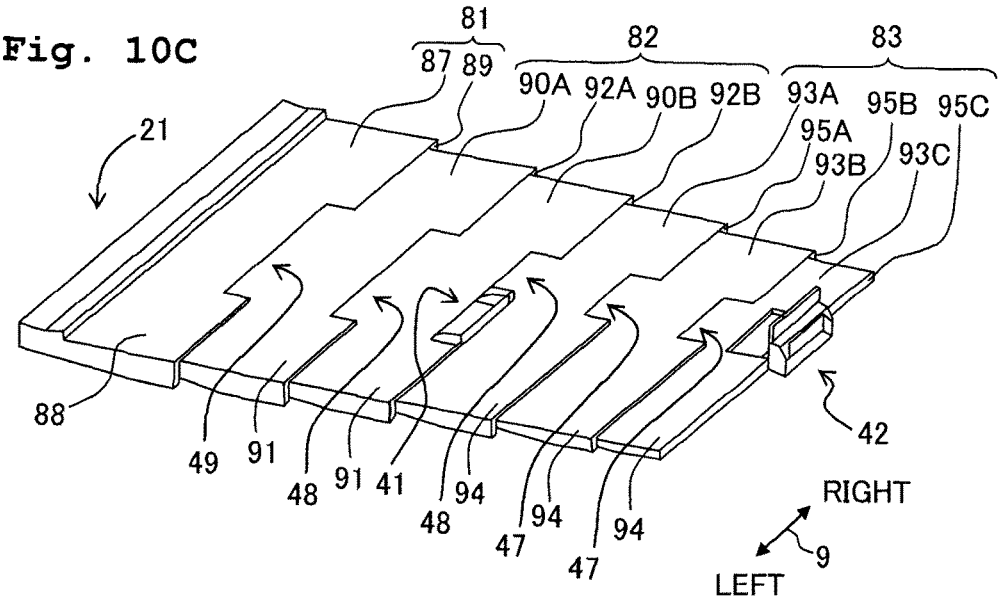

Furthermore, it is preferable that the first holding portion 41 is provided at the rear side of the second holding portion 42 as in the abovementioned embodiment. However, the first holding portion 41 may be provided at the front side of the second holding portion 42, or may be at the same position in the front-rear direction 8 of the second holding portion 42. For instance, the first holding portion 41 may be provided at a right end portion of the discharge tray 21, and the second holding portion 42 may be provided at a left end portion of the discharge tray 21. As depicted in FIG. 10A, the first holding portion 41 and the second holding portion 42 may be arranged side-by-side in the left-right direction. Here, FIG. 10A depicts a state in which the supporting plates 90A and 90B of the second receiving member 82, and the supporting plates 93A, 93B and 93C of the third receiving member 83 are pushed into the first receiving member 81. In this case, the notch 47 in the first receiving member 81 is formed to have a width in the left-right direction 9 that enables to expose both the first holding portion 41 and the second holding portion 42. Furthermore, the notch 48 in the second receiving member 82 is formed to have a width in the left-right direction 9 that enables to expose both the first holding portion 41 and the second holding portion 42. Therefore, as depicted in FIG. 10A, even in a state that both the second receiving member 82 and the third receiving member 83 are pushed into the first receiving member 81, both the first holding portion 41 and the second holding portion 42 are exposed. FIG. 10B depicts a state in which the supporting plates 90A and 90B of the second receiving member 82 have been drawn out from the first receiving member 81, but the supporting plates 93A, 93B and 93C of the third receiving member 83 have not been drawn out from the second receiving member 82. As aforementioned, the notch 48 in the second receiving member 82 is formed to have a width in the left-right direction 9 that enables to expose both the first holding portion 41 and the second holding portion 42, as depicted in FIG. 10A. Therefore, both the first holding portion 41 and the second holding portion 42 are exposed, even in a state of the second receiving member 82 drawn out from the first receiving member 81, and the third receiving member 83 pushed into the second receiving member 82. Moreover, FIG. 10C depicts a state in which the supporting plates 90A and 90B of the second receiving member 82 are drawn out from the first receiving member 81, and the supporting plates 93A, 93B and 93C of the third receiving member 83 are drawn out from the second receiving member 82.

It is preferable that the first holding portion 41 and the second holding portion 42 overlap mutually in the left-right direction as in the abovementioned embodiment. However, the first holding portion 41 and the second holding portion 42 may not be overlapping mutually.

Moreover, in the embodiment, the first holding portion 41 and the second holding portion 42 have been provided at the central portion in the left-right direction. However, the first holding portion 41 and the second holding portion 42 may be provided at a left end portion, which is a portion other than the central portion.

Furthermore, in the embodiment, in a state that the receiving member positioned at the lower side is pushed into the receiving member positioned at the upper side, the receiving member positioned at the upper side has been covering the receiving member positioned at the lower side completely from above. However, an arrangement may be such that the receiving member positioned at the upper side covers only a part of the receiving member positioned at the lower side. For instance, in the state that the receiving member positioned at the lower side is pushed into the receiving member positioned at the upper side, a front end portion of the receiving member positioned at the lower side may be positioned ahead of a front end portion of the receiving member positioned at the upper side. The portion positioned ahead may also function as a first holding portion and a second holding portion of the present teaching.

Figure 11A:
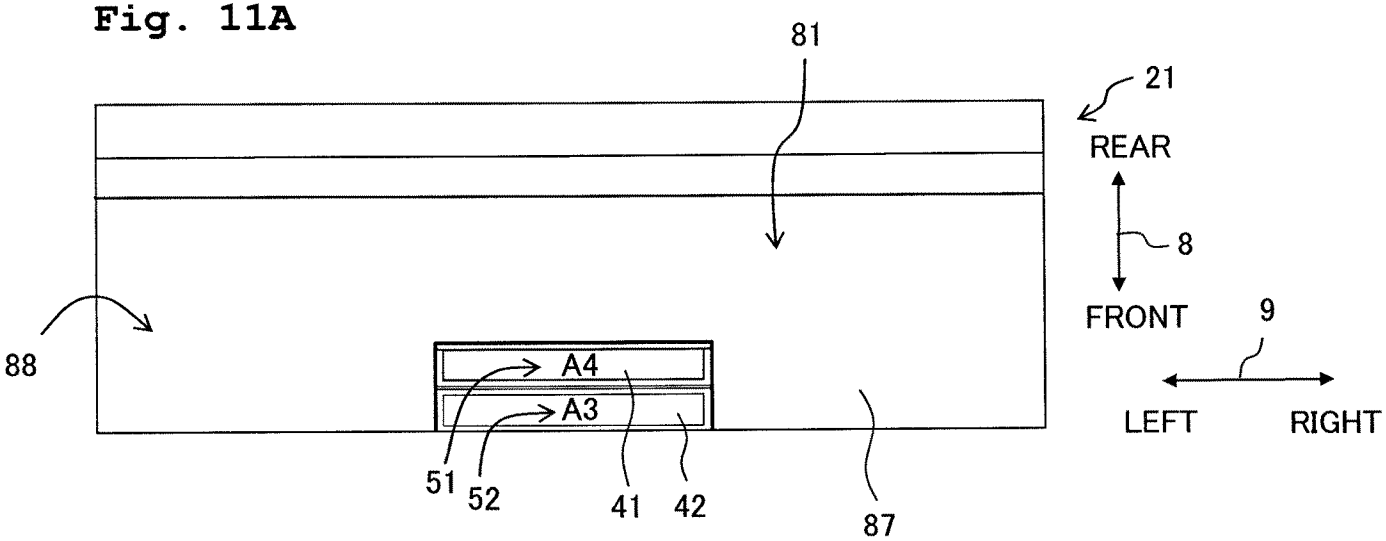
FIG. 11A is a diagram depicting a case in which, a recess of the first holding portion and a recess of the second holding portion are provided with a first display portion and a second display portion respectively.

Moreover, as depicted in FIG. 11A, a first display portion 51 may be provided on an upper surface of the recess 44 of the first holding portion 41. The first display portion 51 is a description indicating the size of the recording sheet 15 that can be supported by the upper surfaces 88 and 91 of the first receiving member 81 and the second receiving member 82, when the user of the multi-function peripheral 10 has drawn the second receiving member 82 out from the first receiving member 81 by holding the first holding portion 41. The first display portion 51 is marked as 'A4' for indicating that the recording sheet 15 that can be supported by the upper surfaces 88 and 91 is of A4 size. The mark on the first display portion 51 may be other than A4, such as B4 for instance.

Moreover, a second display portion 52 may be provided on an upper surface of the recess 46 of the second holding portion 42. The second display portion 52 is a description indicating the size of the recording sheet 15 that can be supported by the upper surfaces 88, 91, and 94 of the first receiving member 81, the second receiving member 82, and the third receiving member 83 respectively, when the user of the multi-function peripheral 10 has drawn the third receiving member 83 and the second receiving member 82 out from the first receiving member 81 by holding the second holding portion 42. The second display portion 52 is marked as 'A3' for indicating that the recording sheet 15 that can be supported by the upper surfaces 88, 91, and 95 is of 'A3' size. The mark on the second display portion 52 may be other than A3, such as B3 for instance, if the size of the recording sheet 15 is larger than the size marked on the first display portion 51.

Figure 11B:
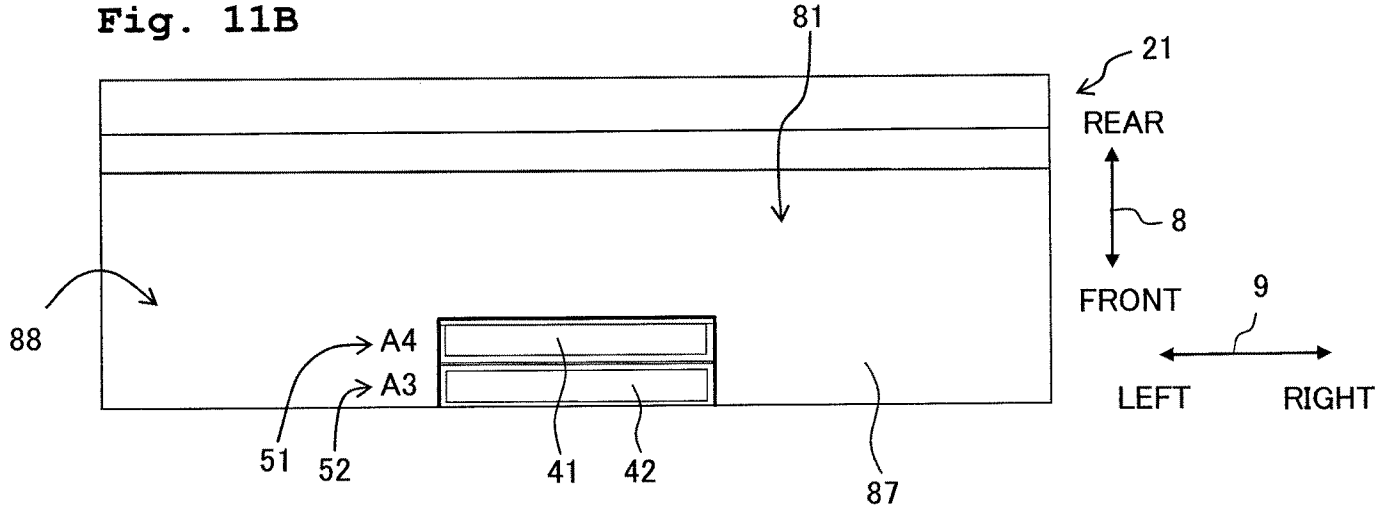
FIG. 11B is a diagram depicting a case in which the first holding portion and the second holding portion are provided near the first holding portion and the second holding portion respectively.

The first display portion 51 and the second display portion 52 may be provided at a location other than the first holding portion 41 and the second holding portion 42, provided that the position is easily visible by the user of the multi-function peripheral 10. The first display portion 51 and the second display portion 52 may be provided near the first holding portion 41 and the second holding portion 42 on the upper surface 88 of the first receiving member 81 (refer to FIG. 11B).

According to such arrangement, by selecting (one of) the first holding portion 41 and the second holding portion 42 to be held based on the mark on the first display portion 51 and the second display portion 52, and drawing out the second receiving member 82 and the third receiving member 83, it is possible to make the sheet supporting surface (upper surfaces 88, 91, and 94) of the discharge tray 21 of a size suitable for the size of the recording sheet 15 to be supported.

Moreover, in the abovementioned arrangement, the discharge tray 21 has been described as an example of a sheet tray of the present teaching. However, the sheet tray of the present teaching is not restricted to the discharge tray 21. The sheet tray of the present teaching may be a bypass tray or a manual-feed-tray by which the recording sheet 15 to be fed to the multi-function peripheral 10 is supported.

What is claimed is:

1. A sheet tray provided on an apparatus, comprising:

a first receiving member including a first supporting surface configured to support a sheet to be fed to, or a sheet discharged from the apparatus;

a second receiving member including a first grip and a second supporting surface configured to support the sheet, wherein the first grip has a first rotation stopper that is pivotable between a posture erected with respect to the second supporting surface, and a posture fallen with respect to the second supporting surface, the second receiving member being supported by the first receiving member to be movable to a first position and a second position, the first position being a position at which an overlapping area of the second supporting surface that overlaps with the first supporting surface becomes largest, and the second position being a position at which an overlapping area of the second supporting surface that overlaps with the first supporting surface becomes smallest, and the first grip being exposed onto the first supporting surface under a condition that the second receiving member is located at the first position wherein the first rotation stopper is configured to be held by a user to move the second receiving member from the first position to the second position and from the second position to the first position; and a third receiving member including a second grip and a third supporting surface configured to support the sheet, the third receiving member being supported by the second receiving member to be movable to a third position and a fourth position, the third position being a position at which an overlapping area of the third supporting surface that overlaps with the second supporting surface becomes largest, the fourth position being a position at which an overlapping area of the third supporting surface that overlaps with the second supporting surface becomes smallest, the second grip being exposed onto the first supporting surface under a condition that the second receiving member is located at the first position and the third receiving member is located at the third position, and the second grip being exposed onto the second supporting surface under a condition that the second receiving member is located at the second position and the third receiving member is located at the third position;

wherein under a condition that the second receiving member is located at the first position and the third receiving member is located at the third position, a position in the first supporting surface at which the first grip is exposed onto the first supporting surface is different from a position at which the second grip is exposed onto the first supporting surface, and the first grip and the second grip are provided at mutually overlapping positions, in a width direction that is orthogonal to a first direction in which the sheet is fed or discharged, and is parallel to the first supporting surface.

2. The sheet tray according to claim 1, wherein, the one of the first receiving member and the second receiving member which is positioned toward the second grip of the third receiving member at the third position has a first groove which is dented along the first direction in which the sheet is fed or discharged, from a downstream end of the first direction up to a position directly above the second grip in a state at which the second receiving member is at the first position and the third receiving member is at the third position.

3. The sheet tray according to claim 1, wherein, the one of the first receiving member and the third receiving member which is positioned toward the first grip of the second receiving member at the first position in which the sheet is fed or discharged, has a second groove which is dented along the first direction, from a downstream end of the first direction up to a position directly above the first grip in a state at which the second receiving member is at the first position and the third receiving member is at the third position.

4. The sheet tray according to claim 1, wherein the first receiving member is provided at an upper side of the second receiving member, and the second receiving member is provided at an upper side of the third receiving member.

5. The sheet tray according to claim 1, wherein the first grip is provided at an upstream side in a first direction in which the sheet is fed or discharged, of the second grip.

6. The sheet tray according to claim 1, wherein the first grip is provided at a central portion of the second receiving member, in the width direction, and the second grip is provided at a central portion of the third receiving member, in the width direction.

7. The sheet tray according to claim 1, wherein the second receiving member has a first display portion which indicates a sheet size that can be supported by the first supporting surface and the second supporting surface in a case that the second receiving member has been moved in a first direction in which the sheet is fed or discharged by holding the first grip, and the third receiving member has a second display portion which indicates a sheet size that can be supported by the first supporting surface, the second supporting surface, and the third supporting surface in a case that the third receiving member and the second receiving member have been moved in the first direction by holding the second grip.

8. The sheet tray according to claim 1, wherein the second grip has a second rotation stopper that is pivoted to a posture erected with respect to the third supporting surface, and a posture fallen with respect to the third supporting surface.

9. The sheet tray according to claim 1, wherein one of the first receiving member and the second receiving member which is positioned toward the second grip of the third receiving member at the third position has a first recess formed therein, which exposes the second grip with maintaining a state in which the third receiving member is movable from the third position to the fourth position, and one of the first receiving member and the third receiving member which is positioned toward the first grip of the second receiving member at the first position has a second recess formed therein, which exposes the first grip with maintaining a state in which the second receiving member is movable from the first position to the second position.

10. The sheet tray according to claim 1, wherein in a state in which the second receiving member is located at a first position in which the sheet is fed or discharged, and the third receiving member is located at the third position, the first grip and the second grip are arranged at a same position in the first direction, and are arranged side-by-side in a direction orthogonal to the first direction.

11. The sheet tray according to claim 2, wherein a portion of the third receiving member facing the first groove is provided with a first protrusion that is to be fitted into the first groove.

12. The sheet tray according to claim 3, wherein a portion of the second receiving member facing the second groove is provided with a second protrusion that is to be fitted into the second groove.

* * * * *